United States Patent [19]

Ueda et al.

[11] Patent Number: 4,747,709

[45] Date of Patent: May 31, 1988

[54] PRINTING APPARATUS WITH VARIABLE IMPACT PRESSURE

[75] Inventors: Hiroyuki Ueda, Yokohama; Mitsuaki Seki, Machida, both of Japan

[73] Assignee: Canon Kabushiki Kaisha, Tokyo, Japan

[21] Appl. No.: 858,528

[22] Filed: Apr. 23, 1986

Related U.S. Application Data

[63] Continuation of Ser. No. 642,738, Aug. 20, 1984, abandoned, which is a continuation of Ser. No. 407,474, Aug. 12, 1982, abandoned.

[30] Foreign Application Priority Data

Oct. 15, 1981 [JP] Japan ..... 56-163499

[51] Int. Cl.[4] ..... B41J 9/00

[52] U.S. Cl. ..... 400/157.3; 400/70; 400/144.2

[58] Field of Search ..... 101/93.03; 400/70, 144.2, 400/144.3, 157.3, 166

[56] References Cited

U.S. PATENT DOCUMENTS

| | | | |
|---|---|---|---|
| 3,172,353 | 3/1965 | Helms | 101/93.03 |
| 3,712,212 | 1/1973 | Beery | 101/93.03 |
| 3,858,509 | 1/1975 | Grundherr | 400/144.2 X |
| 4,004,504 | 1/1977 | Lundqvist | 101/93.03 |
| 4,037,208 | 7/1977 | Osterlund et al. | 400/157.3 |
| 4,074,798 | 2/1978 | Berger | 400/144.3 |
| 4,103,617 | 8/1978 | O'Brien et al. | 101/93.03 |
| 4,118,129 | 10/1978 | Grundherr | 400/144.2 |
| 4,189,246 | 2/1980 | Kane et al. | 400/144.2 |
| 4,217,055 | 8/1980 | Moon | 400/144.2 |
| 4,226,546 | 10/1980 | Hoffman | 400/144.2 |
| 4,261,039 | 4/1981 | Baker et al. | 400/70 X |
| 4,264,220 | 4/1981 | Okcuoglu | 400/144.2 |
| 4,314,769 | 2/1982 | James, III | 400/144.2 |
| 4,349,770 | 9/1982 | Ragen | 400/144.2 X |
| 4,351,618 | 9/1982 | Prewarski | 400/166 |
| 4,353,656 | 10/1982 | Sohl et al. | 400/157.3 |
| 4,389,935 | 6/1983 | Arai | 400/157.3 X |
| 4,390,293 | 6/1983 | Gubau et al. | 400/144.2 |
| 4,569,607 | 2/1986 | Takemoto | 400/157.3 X |

FOREIGN PATENT DOCUMENTS

| | | | |
|---|---|---|---|
| 0017918 | 10/1980 | European Pat. Off. | 400/157.3 |
| 0118882 | 9/1981 | Japan | 400/166 |
| 2087115 | 5/1982 | United Kingdom | 400/144.2 |
| 2110853 | 6/1983 | United Kingdom | 157.3/ |

OTHER PUBLICATIONS

IBM Technical Disclosure Bulletin, "Controller for Electromechanical Print Hammer", W. Greer et al, vol. 22, No. 8A, Jan. 1980, pp. 3294–3295.

IBM Technical Disclosure Bulletin "Typewriter Print Impression", Anderson et al, vol. 24, No. 8, Jan. 1982, pp. 4316–4318.

*Primary Examiner*—Ernest T. Wright, Jr.

*Attorney, Agent, or Firm*—Fitzpatrick, Cella, Harper & Scinto

[57] ABSTRACT

In a printing apparatus address data accesses an address of a time table to vary an impact pressure and supplementary data of each typeface (or character) of a printing type wheel. Thse data are stored in various memories. Data input/output and its processing are controlled by a plurality of microprocessors connected to each other through an interface.

36 Claims, 11 Drawing Sheets

FIG. 6

IT

| UPPER DIGIT CODE \ LOWER DIGIT CODE | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 2 (CHARACTER) | 06 SPACE | 15 ! | 25 " | 35 # | 35 $ | 35 % | 35 & | 15 ' | 15 ( | 15 ) | 45 * | 25 + | 05 , | 15 — | 05 . | 15 / |
| 3 (CHARACTER) | 25 0 | 25 1 | 25 2 | 25 3 | 25 4 | 25 5 | 25 6 | 25 7 | 35 8 | 35 9 | 15 : | 15 ; | 15 < | 25 = | 15 > | 15 ? |
| 4 (CHARACTER) | 35 @ | 36 A | 36 B | 36 C | 36 D | 36 E | 36 F | 36 G | 36 H | 24 I | 25 J | 36 K | 36 L | 47 M | 36 N | 36 O |
| A (CHARACTER) | 26 μ | 25 f | 24 ¿ | 24 ¡ | 24 ì | 35 ª | 35 º | 15 ¡ | 37 Æ | 37 æ | 36 Ñ | 36 ñ | 25 Φ | 35 φ | 16 — | 15 ¯ |
| B (CHARACTER) | 36 ¥ | 06 | 00 | 00 | 00 | 00 | 05 | 05 | 05 | 05 | 05 | 15 ´ | 15 ` | 15 ¨ | 15 ^ | 16 ~ |

PERMANENT SPACE

CARRIAGE SHIFT AMOUNT INFORMATION

PORTION OF ADDRESS INFORMATION OF TT

FIG. 7

WT

| UPPER DIGIT / LOWER DIGIT | 2 | | 3 | | 4 | | 5 | | 6 | | 7 | |
|---|---|---|---|---|---|---|---|---|---|---|---|---|
| | CHAR-ACTOR | NO | CHAR-ACTOR | NO | CHAR-ACTOR | NO | CHAR-ACTOR | NO | CHAR-ACTOR | NO | CHAR-ACTOR | NO |
| 0 | _ | 1 | 0 | 23 | @ | 0 | P | 35 | ç | 0 | p | 73 |
| 1 | ! | 16 | 1 | 24 | A | 45 | Q | 32 | a | 64 | q | 63 |
| 2 | " | 5 | 2 | 28 | B | 8 | R | 30 | b | 70 | r | 56 |
| 3 | # | 94 | 3 | 26 | C | 29 | S | 34 | c | 60 | s | 58 |
| 4 | $ | 38 | 4 | 20 | D | 3 | T | 43 | d | 59 | t | 68 |
| 5 | % | 9 | 5 | 21 | E | 12 | U | 37 | e | 62 | u | 67 |
| 6 | & | 47 | 6 | 22 | F | 44 | V | 46 | f | 61 | v | 65 |
| 7 | ' | 78 | 7 | 31 | G | 15 | W | 14 | g | 71 | w | 75 |
| 8 | ( | 18 | 8 | 25 | H | 19 | X | 6 | h | 66 | x | 49 |
| 9 | ) | 13 | 9 | 27 | I | 42 | Y | 48 | i | 74 | y | |
| A | * | 33 | : | 50 | J | 40 | Z | | | | | |
| B | + | 7 | ; | 77 | K | | | | | | | |
| C | , | 95 | | | | | | | | | | |
| D | - | | | | | | | | | | | |

FIG. 9

| H \ L | 0 | 1 | 2 | 3 | 4 |
|---|---|---|---|---|---|
| 0 | 3000<br>0BB8 | 3200<br>0C80 | 3400<br>0D48 | 3600<br>0E10 | 3800<br>0ED8 |
| 1 | 3100<br>0C1C | 3300<br>0CE4 | 3500<br>0DAC | 3700<br>0E74 | 3900<br>0F3C |
| 2 | 3100<br>0C1C | 3300<br>0CE4 | 3600<br>0E10 | 3700<br>0E74 | 3900<br>0F3C |
| 3 | 3100<br>0C1C | 3400<br>0D48 | 3600<br>0E10 | 3700<br>0E74 | 3900<br>0F3C |
| 4 | 3200<br>0C80 | 3500<br>0DAC | 3700<br>0E74 | 3800<br>0ED8 | 4000<br>0FA0 |
| 5 | 3200<br>0C80 | 3600<br>0E10 | 3800<br>0ED8 | 3900<br>0F3C | 4100<br>1004 |

M

TIME TABLE (TT)

FIG. 10

ROM2 (TT)

| | | |
|---|---|---|
| | 0B | B8 |
| +2 | 0C | 80 |
| +4 | 0D | 48 |
| +6 | 0E | 10 |
| | 0E | D8 |
| | 0E | D8 |
| | 0F | 3C |
| | 10 | 04 |

PRINTING APPARATUS WITH VARIABLE IMPACT PRESSURE

This application is a continuation of application Ser. No. 642,738, filed Aug. 20, 1984, now abandoned, which is a continuation of U.S. Pat. Appln. Ser. No. 407,474, filed Aug. 12, 1982, now abandoned.

BACKGROUND OF THE INVENTION

1. Field of the Invention

The present invention relates to a printing apparatus providing variable print impact pressure which thereby prevents nonuniform printing density caused by a difference between the areas of different typefaces.

2. Description of the Prior Art

U.S. Pat. No. 3,858,509 is an example of prior art in the field of printing apparatus of the type to which the subject invention relates.

The patent mentioned discloses a printing apparatus which provides only two different levels of type impact pressure and which cannot provide a sufficient range of the impact pressure for various typefaces. The two different levels of impact pressure are provided by two one-shot multivibrators. Therefore, in order to increase the number of levels of impact pressure, a larger number of one-shot multivibrators must be provided. As a result, the printing apparatus itself would become large and would be expensive to manufacture.

SUMMARY OF THE INVENTION

It is, therefore, an object of the present invention to eliminate the drawbacks in conventional apparatus of the type described above.

It is another object of the present invention to provide printing apparatus implemented with LSI (large-scale integrated) circuitry at low cost even if the number of levels of impact pressure is greatly increased.

It is still another object of the present invention to provide a printing apparatus which is capable of arranging data effectively and utilizing hardware economically by virtue of its implementation with LSI circuitry.

It is still another object of the present invention to provide a printing apparatus having microprocessors, read-only memories and random access memories which are arranged in both a key input section and a printing section, in order to achieve highly precise printing of high quality at high speed.

BRIEF DESCRIPTION OF THE DRAWING

FIGS. 6, 7, 9 and 10 are tables for explaining the mode of operation of the printing apparatus shown in FIG. 1;

DETAILED DESCRIPTION OF THE PREFERRED EMBODIMENTS

The preferred embodiments of the present invention will be described in detail with reference to the accompanying drawing.

Figure 1A:
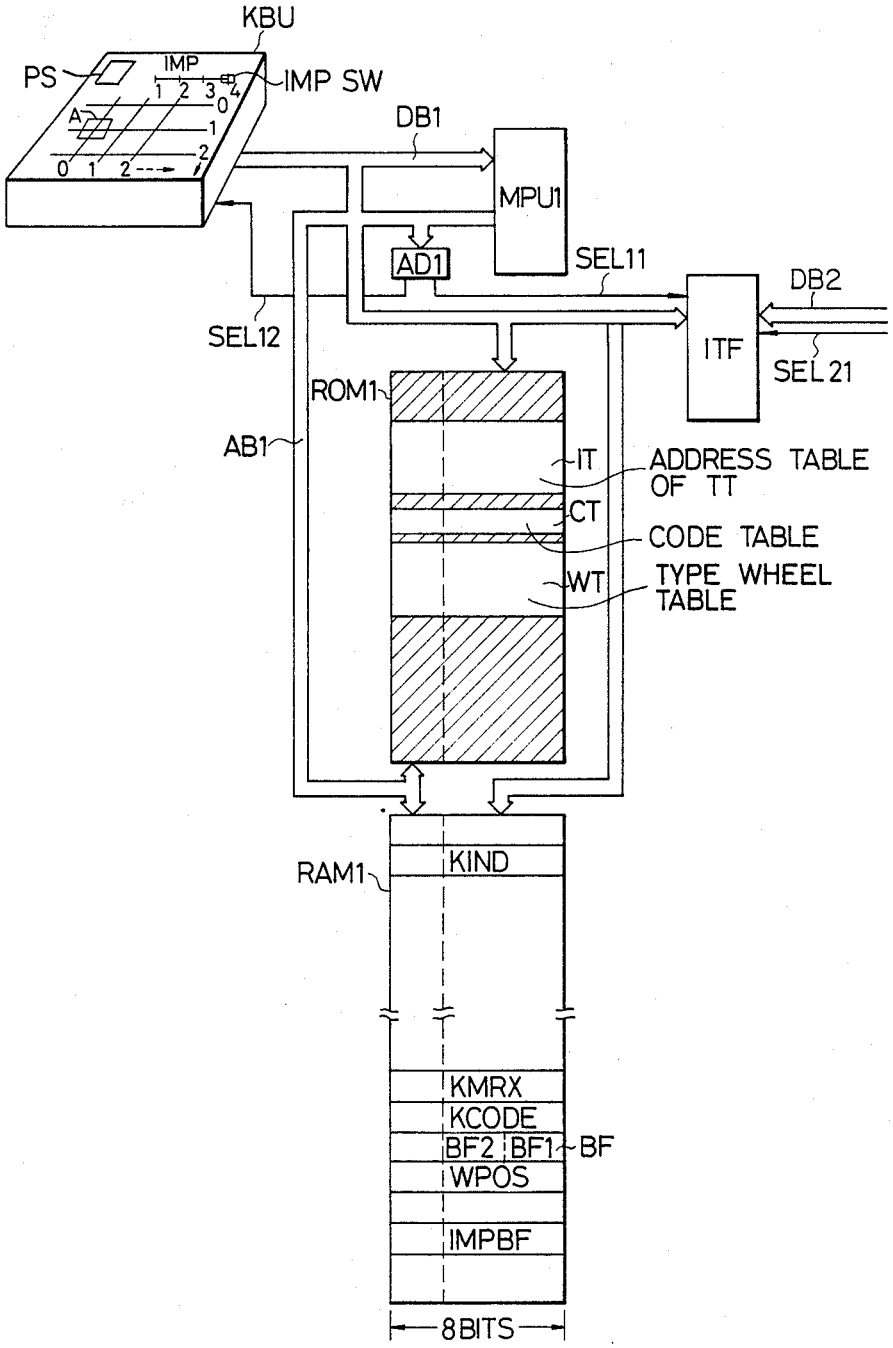
FIGS. 1A and 1B collectively are a block diagram of a printing apparatus according to a first embodiment of the present invention.
Figure 1B:
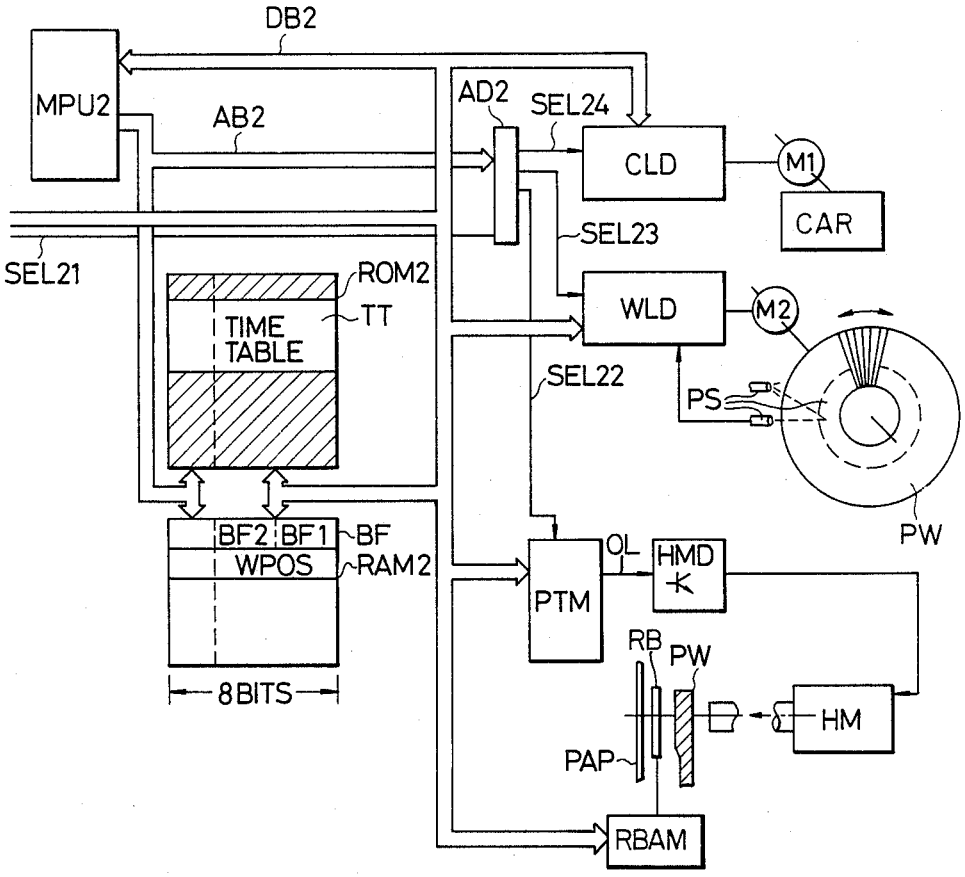

FIGS. 1A and 1B collectively are a block diagram showing the overall arrangement of a printing apparatus according to a first embodiment of the present invention. A keyboard unit KBU is connected to a microprocessor MPU1, an interface ITF, a read-only memory ROM1 and a random access memory RAM1 through a data bus DB1. An address decoder AD1 is connected to the microprocessor MPU1, the read-only memory ROM1 and the random access memory RAM1 through a system address bus AB1. A device select line SEL11 connects the address decoder AD1 to the interface ITF. A device select line SEL12 connects the address decoder AD1 to the keyboard unit KBU.

Additionally, a microprocessor MPU2 is connected to a carriage control/drive section CLD, the interface ITF, a wheel control/drive section WLD, a programmable timer PTM, a read-only memory ROM2 and a random access memory RAM2 through a data bus DB2. The microprocessor MPU2 is also connected to an address decoder AD2, the read-only memory ROM2 and the random access memory RAM2 through a system address bus AB2. A device select line SEL21 connects the address decoder AD2 to the interface ITF. A device select line SEL22 connects the address decoder AD2 to the programmable timer PTM. A device select line SEL23 connects the address decoder AD2 to the wheel control/drive section WLD. Further, a device select line SEL24 connects the address decoder AD2 to the carriage control/drive section CLD. The carriage control/drive section CLD is connected to a carriage drive servo motor M1, and the wheel control/drive section WLD is connected to a wheel drive servo motor M2. Photosensors PS each one of which comprises a light-emitting diode, a photodiode and a photoencoder are arranged to receive various outputs in accordance with rotation of a printing type wheel PW. The programmable timer PTM is connected to a hammer drive section HMD which drives a printing hammer HM. A portion of a printing paper sheet PAP, which may be mounted on a conventional platen (not shown), opposes the printing type wheel PW with a printing ribbon RB interposed therebetween.

The printing apparatus shown in FIGS. 1A and 1B is divided into two systems controlled respectively by the microprocessor MPU1 and the microprocessor MPU2. The two systems are coupled by the interface ITF. The microprocessors MPU1 and MPU2 are the main components in the two systems and perform various types of control and operations as will be described below. Address data from the microprocessor MPU1 is supplied to the read-only memory ROM1 and the random access memory RAM1 through the address bus AB1, while address data from the microprocessor MPU2 is supplied to the read-only memory ROM2 and the random access memory RAM2 through the address bus AB2. The address data decoded by the address decoder AD1 is supplied to the interface ITF and the keyboard unit KBU respectively through the device select lines SEL11 and SEL12. Also, the address data decoded by the address decoder AD2 is supplied to the interface ITF, the programmable timer PTM, the wheel control/drive section WLD and the carriage control/drive section CLD respectively through the device select lines SEL21, SEL22, SEL23 and SEL24, so that a desired device can be selected for operation.

Command or program data for sequence control and arithmetic operations by the microprocessors MPU1 and MPU2 and permanent data are stored in the read-only memories ROM1 and ROM2, respectively. The command data is stored in hatched portions of the read-only memories ROM1 and ROM2 in FIGS. 1A and 1B, while the remaining memory areas in ROM1 and ROM2 store permanent string data, that is, tables. According to the first embodiment, the read-only memory ROM1 stores an address table IT that includes address data for a time table TT in the read-only memory ROM2 to be described later, a code table CT that includes internal operating data for internal operating code conversion, and a type wheel table WT that includes printing position data which indicates the position of each of the printing type characters CH (FIG. 2) on the type wheel PW. Printing hammer drive duration data is stored in the time table TT in the memory ROM2. The drive duration of the hammer HM is variable to change impact energy in accordance with the type character to be printed and with other variables as described below, whereby the impact pressure from type character to type character CH is variable.

The random access memories RAM1 and RAM2 temporarily store data necessary for processing, but details thereof will be described later. When the operator presses an alphanumeric key or the like, for example "A" on the keyboard unit KBU or slides an impact pressure adjusting slide switch IMPSW, operating data representative of the pressed key "A" or slide switch IMPSW is supplied to the microprocessor MPU1 through the data bus DB1. The keyed-in data may comprise 8 bits and the line and row of the key matrix of the keyboard unit KBU respectively correspond to the most signficant 4 bits and the least significant 4 bits of the 8 bits of data. Each of the address decoders AD1 and AD2 causes one of the device select lines SEL11, SEL12, SEL21, SEL22, SEL23, SEL24 to be active to select a specific device in accordance with data from one of the address buses AB1 and AB2 each one of which comprises a plurality of address lines. The interface ITF couples the data bus DB1 for the microprocessor MPU1 to the data bus DB2 for the microprocessor MPU2. The microprocessor MPU1 can access the interface ITF through the device select line SEL11, while the microprocessor MPU2 can access it through the device select line SEL21.

Figure 2:
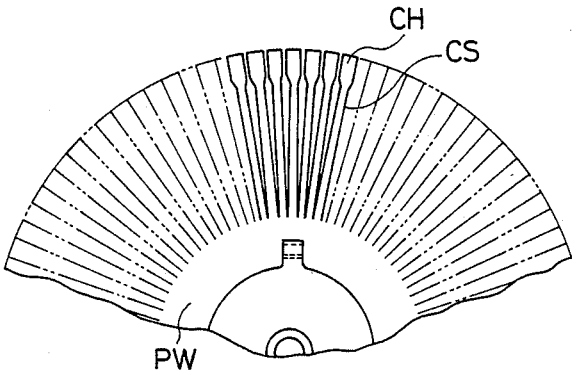
FIG. 2 is a partial view of an example of a printing type wheel.

The carriage control/device section CLD initiates its operation when it receives carriage position data from the microprocessor MPU2 to control and drive the servo motor M1, where a conventional carriage CAR that carries the print wheel PW and hammer HM is moved to a desired position and stops there. Simultaneously, the wheel control/drive section WLD initiates its operation when it receives data representing the desired or target rotational position of the printing type wheel PW, that is representing a desired type character CH to be printed, from the microprocessor MPU2 to control and drive the servo motor M2, whereby the printing wheel PW is rotated to the target rotational position and stops there. Further, the wheel control/drive section WLD supplies a signal which indicates that rotating movement has stopped to the micrprocessor MPU2. The output OL of the programmable timer PTM becomes active when a time constant is written thereinto by the microprocessor MPU2. When a predetermined time corresponding to the time constant elapses, the output line OL becomes inactive. The output line OL of the programmable timer PTM is connected to the hammer drive section HMD which supplies power of the hammer HM for the duration of time predetermined for the programmable timer PTM. The hammer HM is moved in the direction indicated by the arrow in FIG. 1B for the predetermined time to provide a single impact to one character type CH on the printing type wheel PW to print one character on the printing paper sheet PAP through the printing ribbon RB. That is, the corresponding character is transferred to the printing paper sheet PAP. Ninety-six character spokes CS are radially arranged around the printing type wheel PW, as shown in FIG. 2. A character type CH is arranged at the top of each one of the character spokes CS.

The mode of operation of the printing apparatus shown in FIGS. 1A and 1B will now be described mainly with reference to the microprocessor MPU1 and MPU2. When the operator turns on a power switch PS, the microprocessors MPU1 and MPU2 are independently initialized. The wheel control/drive section WLD causes the printing type wheel PW to rotate once in accordance with a command from the microprocessor MPU2 to detect the type style of the character type CH on the printing type wheel PW mounted in the printing apparatus. A detection signal representing the type style is then supplied to the microprocessor MPU2. For example, if the current type style is "PICA", data of numeral "2" is supplied from the wheel control/drive section WLD to the microprocessor MPU2. The microprocessor MPU2 supplies data corresponding to the numeral "2" to the microprocessor MPU1 through the interface ITF. That is, the microprocessor MPU1 receives data corresponding to numeral "2" from the interface ITF. This data is then written in a memory data area KIND in the random access memory RAM1. Thereafter, the microprocessors MPU1 and MPU2 execute an initializing sequence required when turning on the power switch PS. Then, the printing apparatus is kept in a waiting mode awaiting keyed-in data.

Figure 3:
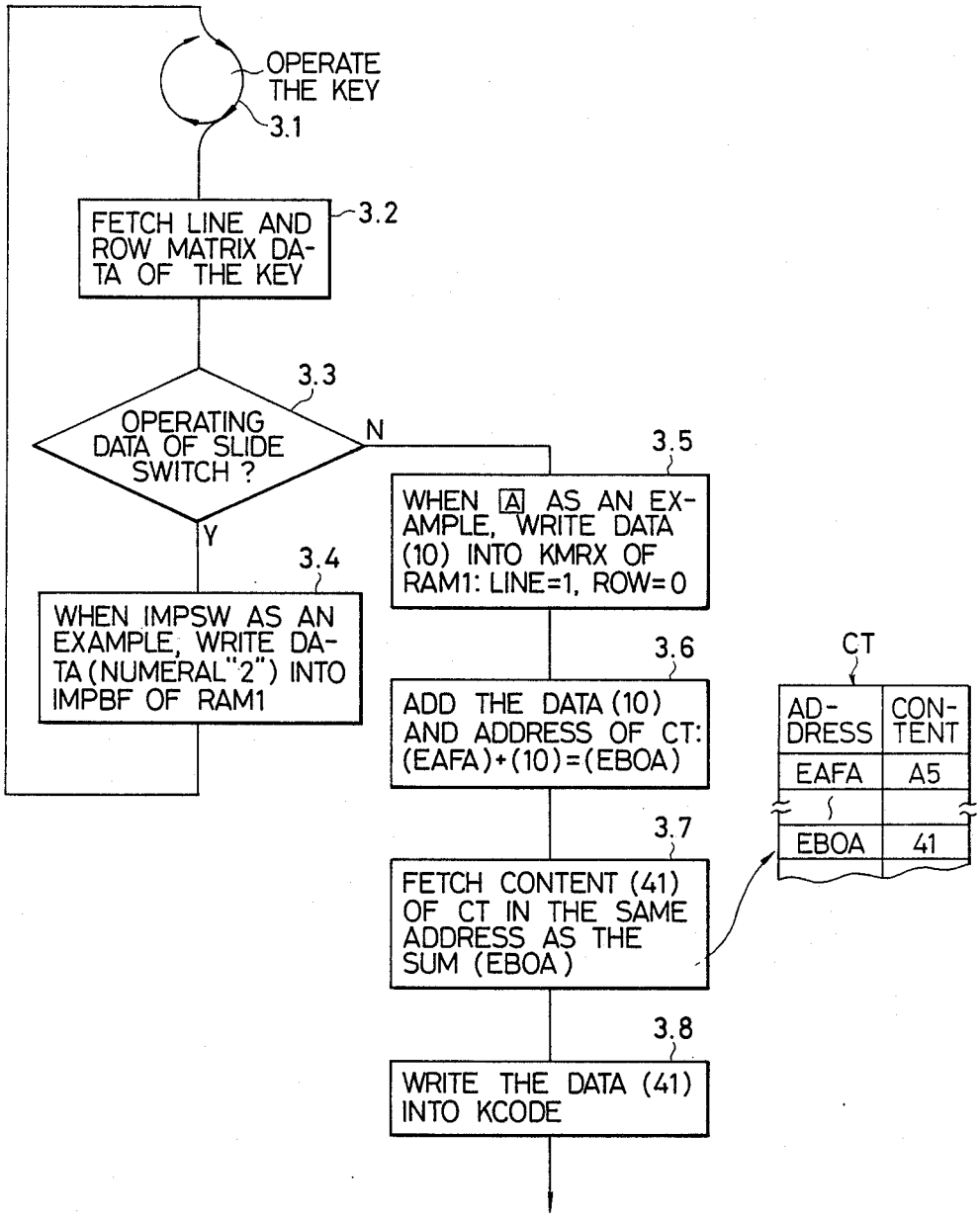
FIGS. 3 to 5 and FIG. 8 are flowcharts for explaining the mode of operation of the printing apparatus shown in FIGS. 1A and 1B.

The operating sequence control functions of the microprocessor MPU1 in the waiting mode are shown by the flowchart in FIG. 3. For example, when the operator presses key "A", the control sequence advances from waiting mode loop 3.1 to step 3.2. The microprocessor MPU1 accesses the keyboard unit KBU to fetch line and row matrix data of the pressed key. Input operating code data in hexidecimal form, e.g., $(10)_{HEX}$ which comprises, for example, 8 bits are obtained for the pressed key "A". In step 3.3, the microprocessor MPU1 determines that data $(10)_{HEX}$ does not correspond to operating data of the impact pressure adjusting slide switch IMPSW. The control sequence branches to NO (N) in step 3.3 and advances to step 3.5. In step 3.5, the input operating code data $(10)_{HEX}$ is temporarily stored in a memory area KMRX of the random access memory RAM1. The data $(10)_{HEX}$ is then processed further in order to print the character "A". This data is stored until the operator presses another key. In step 3.6, for converting such input operating code or KMRX data to an internal operating code for easy processing, the following operation is performed. The data $(10)_{HEX}$ indicating the line and row matrix data of the key "A" is added to head (or start) address $(EAFA)_{HEX}$ (16 bits) of the code table CT in the read-only memory ROM 1 as follows: $(EAFA)_{HEX}+(10)_{HEX}=(EBOA)_{HEX}$. The sum $(EBOA)_{HEX}$ is then defined as the address of the internal code corresponding to key "A". This address is accessed in the code table CT to obtain the corresponding internal operating code data $(41)_{HEX}$, in step 3.7. In step 3.8, the internal code data $(41)_{HEX}$ is written in a memory area KCODE of the random access memory RAM1. Data in the memory area KCODE remains unchanged as does the input operating code in the memory area KMRX until the operator presses another key. However, is it is determined in step 3.3 that the slide switch IMPSW has been operated to produce operating data, the sequence control advances to step 3.4. In this step, if the slide switch is the impact pressure adjusting slide switch IMPSW, data corresponding to the adjusted or desired impact pressure, for example, the numeral "2" is written in a memory area IMPBF of the random access memory RAM1.

Figure 4:
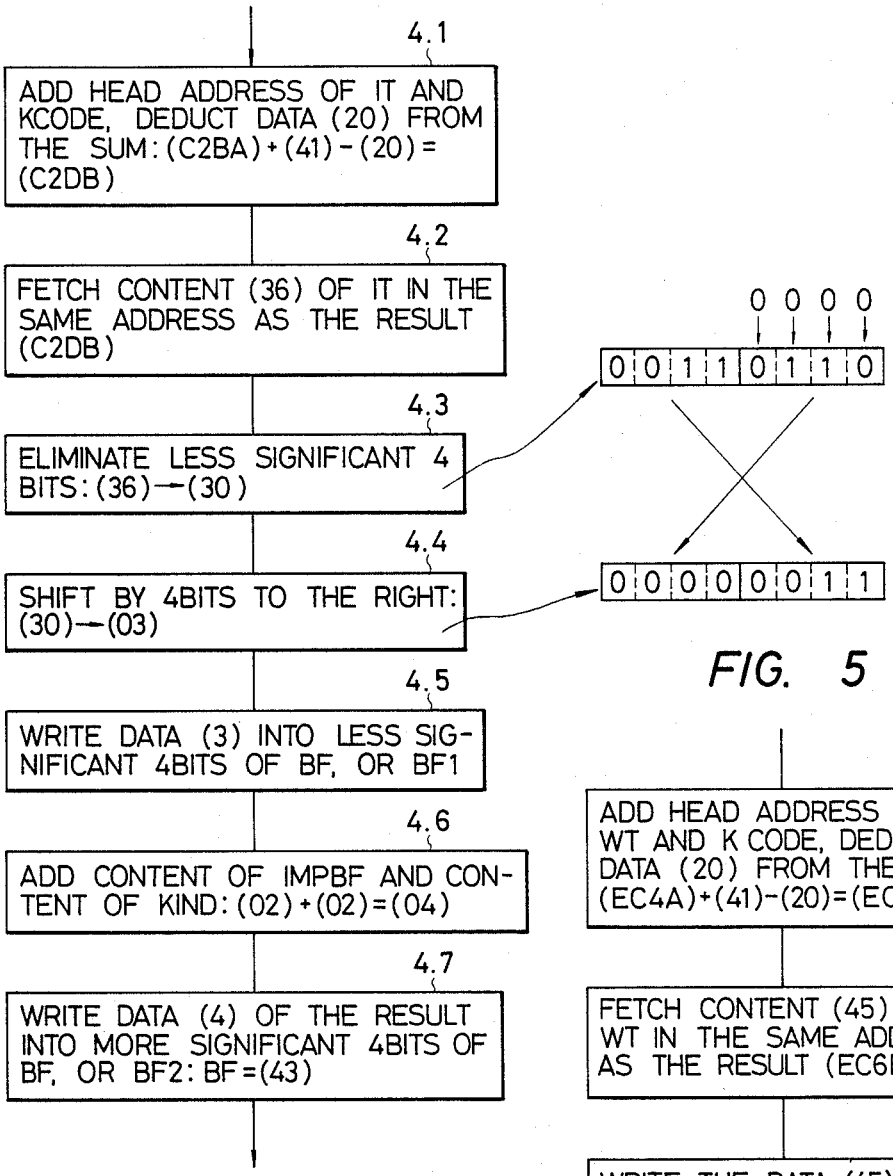

Thereafter, the microprocessor MPU1 processes internally stored data to arrange for printing of characters. WHen this processing is completed, printing operation is initiated. Data necessary for printing are the position of the desired character to be printed on the printing type wheel PW and a hammer impact pressure for printing the desired character. The control sequence of the microprocessor MPU1 for the printing operation is shown in FIG. 4. In step 4.1, in order to obtain the impact pressure information of the character, hexidecimal head (or start) address $(C2BA)_{HEX}$ of the address table IT in ROM 1 for the time table TT is added to the data $(41)_{HEX}$ representing the character to be printed (e.g. "A") and stored in the memory area KCODE of RAM 1. Hexidecimal data $(20)_{HEX}$ indicating a minimum value of the internal operating code is subtracted from the result of this addition, since the internal operating code starts from the data $(20)_{HEX}$. In this manner, in step 4.1, $(C2DB)_{HEX}=(C2BA)_{HEX}+(41)_{HEX}-(20)_{HEX}$, partial data needed to address the time table TT in ROM 2, is obtained. In step 4.2, the address $(C2DB)_{HEX}$ in the address table IT shown in FIG. 6 fetches data $(36)_{HEX}$ corresponding to the key "A", and supplies it to the microprocessor MPU1. In the first embodiment, data indicating the amount of feeding of the carriage CAR for proportional spacing of characters is stored as supplementary data for each character in the address table IT. That is, each location in the table IT (FIG. 6) corresponds to one character type CH on the print wheel PW and stores supplementary data related to proportional spacing of that character type CH and partial address data later used, as will be described in detail below, to address the time table TT in ROM 2 to determine a duration of hammer impact for that character type CH. Data $(6)_{HEX}$ corresponding to the less significant 4 bits of the supplementary data is all set to logical level "0" as shown in step 4.3, so that data $(30)_{HEX}$ corresponding to the more significant 4 bits of the the remaining data is retained in the microprocessor MPU1. Although proportional spacing supplementary data stored in the address table IT is shown in FIG. 6, data indicating the amount of feeding of the ink ribbom RB may be stored therein as the supplementary data for each character type CH. Internal code data $(20)_{HEX}$ to $(BF)_{HEX}$, stored in code table CT, respectively, each correspond to one byte. Subsequently, in step 4.4, the result in step 4.3 is shifted to the lower position four times by one bit each, so that the data $(30)_{HEX}$ is converted to data $(03)_{HEX}$. In step 4.5, the less significant 4 bit data $(3)_{HEX}$ of the result obtained in setp 4.4 is written in less significant 4 bits of a portion BF1 of the memory area BF of the random access memory RAM1. Thus, a portion of the address data for the time table TT is obtained. In step 4.6, data $(02)_{HEX}$ stored in the memory area KIND representing the type style of type CH on the printing wheel PW is added to data $(02)_{HEX}$ in a memory area IMPBF in RAM 1, to be described later, to obtain data $(04)_{HEX}$. Less significant 4 bit data $(4)_{HEX}$ of the result of this addition is written in the more significant 4 bit locations of a portion BF2 of the memory area BF in RAM 1 in step 4.7. Therefore, data stored in the memory area BF becomes data $(43)_{HEX}$.

Figure 5:
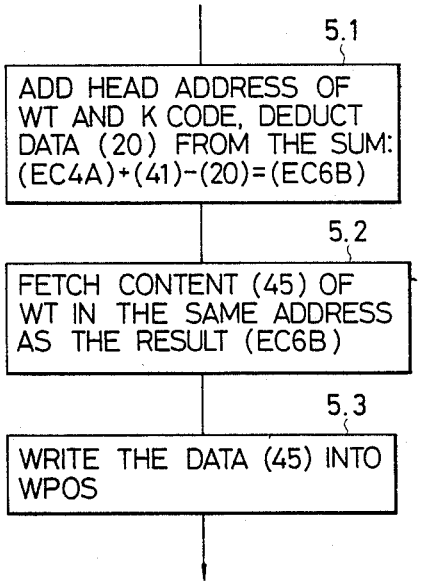

Meanwhile, relating to data the position of the desired character type CH on printing type wheel PW, to be printed, is obtained by processing as shown in FIG. 5. In step 5.1, an operation similar to that in step 4.1 is performed to obtain an address at which character position data for the desired character type CH is stored. Head (or start) address $(EC4A)_{HEX}$ of the type wheel table WT in ROM 1 is added to the internal operating code data $(41)_{HEX}$ in the memory area KCODE representing the desired character type CH (e.g. "A"). Data $(20)_{HEX}$ which corresponds to the minimum value of the internal code is subtracted from the result of this addition. Thus, $(EC6B)_{HEX}=(EC4A)_{HEX}+(41)_{HEX}-(20)_{HEX}$ is obtained. In step 5.2, the result $(EC6B)_{HEX}$ is used as address data to read out the contents in address $(EC6B)_{HEX}$ of the type wheel table WT which represents the position of the printing wheel PW of the desired character type CH. The content $(45)_{HEX}$ is supplied to the microprocessor MPU1. In step 5.3, the content is written in a memory area WPOS of the random access memory RAM1. Character position data is stored in the type wheel table WT in the manner shown in FIG. 7 which shows each character type and its corresponding position data at each of a number of hexidecimal denoted addresses indicated by upper and lower digits.

The memory area IMPBF of the random access memory RAM1 will be described in detail. In the process shown in FIG. 3, the sequence goes out of the loop 3.1 when the operator presses a key on the keyboard unit KBU as described above. Further, the sequence also goes out of the loop 3.1 in response to the sliding movement of the impact pressure adjusting slide switch IMPSW. The control sequence advances to step 3.4 through steps 3.2 and 3.3 when the slide switch IMPSW is actuated. In step 3.4, data corresponding to the operating data of the impact pressure adjusting slide switch IMPSW on the keyboard unit KBU in accordance with the line and row matrix data, and impact pressure data specified by the switch IMPSW is written in the memory area IMPBF of the random access memory RAM1. For example, when the maximum impact pressure is decreased to a low impact pressure by one step, data $(02)_{HEX}$ is written in the memory area IMPBF.

Data $(43)_{HEX}$ and $(45)_{HEX}$ are respectively stored in the memory areas BF and WPOS of the random access memory RAM1 in the example described above.

The microprocessor MPU1 transfers data in the memory areas BF and WPOS of the random access memory RAM1 to the microprocessor MPU2 through the interface ITF in the order mentioned. The microprocessor MPU2 determines that data from the microprocessor MPU1 is retained in the interface ITF and fetches it in step 8.1 shown in FIG. 8. The fetched data is the same as data in the memory area BF of the random access memory RAM1 and is written in the memory area BF of the random access memory RAM2. In the same manner, after the data retained in the interface ITF is fetched in the microprocessor MPU2, data in the memory area WPOS of the random access memory RAM1 is retained in the interface ITF. These pieces of data are fetched in the microprocessor MPU2 in step 8.2 and are written in the memory area WPOS of the random access memory RAM2.

The microprocessor MPU2 thus obtains character position data for the desired character type CH on the printing type wheel PW and supplies a command to the wheel control/drive section WLD in step 8.3 so that the section WLD causes the printing type wheel PW to rotate to the target or desired character position. The wheel control/drive section WLD controls the wheel servo motor M2 and detects rotation or interruption of rotation of the printing type wheel PW in loop 8.4. In the first embodiment, when desired character type CH, e.g. "A" arrives at the hammer HM, the wheel control/drive section WLD supplies a signal which indicates interruption of rotation to the microprocessor MPU2. In loop 8.4, when the microprocessor MPU2 receives the signal from the wheel control/drive section WLD, the microprocessor MPU2 is kept in the waiting state for about 5 msec to allow slight vibration of the printing type wheel PW to stop. In step 8.5, the microprocessor MPU2 accesses the time table TT using the complete address data now stored collectively in portions BF1 and BF2 of the random access memory RAM2, whereby time data is obtained for the programmable timer PTM.

The microprocessor MPU2 accesses data in the following manner. FIG. 9 shows data of the time table TT, where L represents successive locations in the table TT determined by data in the portion BF1 of the memory area BF of the random access memory RAM2 and H represents successive locations in the table TT determined by data in the portion BF2 thereof. The numeral in the upper part of each location M in a column of the time table TT represents a decimal number that may represent the number of microseconds of hammer actuation duration for that address, while the numeral in the lower part of each location M represents a hexadecimal number. Each number that represents the address data in BF in RAM 2 corresponds to 2-bytes of data. Data is stored in the read-only memory ROM2 in the manner shown in FIG. 10. In order to read out desired data from the read-only memory ROM2, the multiplication result of data in the portion BF1 by data $(2)_{HEX}$ is added to the multiplication result of the data in the portion BF2 by data $(0A)_{HEX}$ which corresponds to decimal number "10", and the sum is added to head (or start) address $(3CF1)_{HEX}$ of the time table TT to obtain data which is then read out. For example, since $BF=(43)_{HEX}$, the following relation is obtained: $(03)_{HEX}\times(02)_{HEX}+(04)_{HEX}\times(OA)_{HEX}+(3CF1)_{HEX}=(06)_{HEX}+(28)_{HEX}+(3CF1)_{HEX}=(3D1F)_{HEX}$. Thus, data $(0E)_{HEX}$ is stored at the address $(3D1F)_{HEX}$ of the time table TT and data $(D8)_{HEX}$ is stored in the address $(3D20)_{HEX}$. As a result, the microprocessor MPU2 obtains 2-byte time data $(0ED8)_{HEX}=3800$ (decimal) from the time table TT. This time data is written in the programmable timer PTM in step 8.6.

The programmable timer PTM in which the time data is programmed receives a signal with a period of 1 μsec as the reference clock pulse. The hammer HM is driven in the direction indicated by the arrow in FIG. 1 for 3,800 μsec. Thus, printing is completed in response to the operation where the operator presses a key once. Subsequently, the microprocessor MPU1 gives the microprocessor MPU2 a command to move the carriage CAR. As a result, the carriage CAR is moved to prepare for the next printing operation.

Figure 11A:
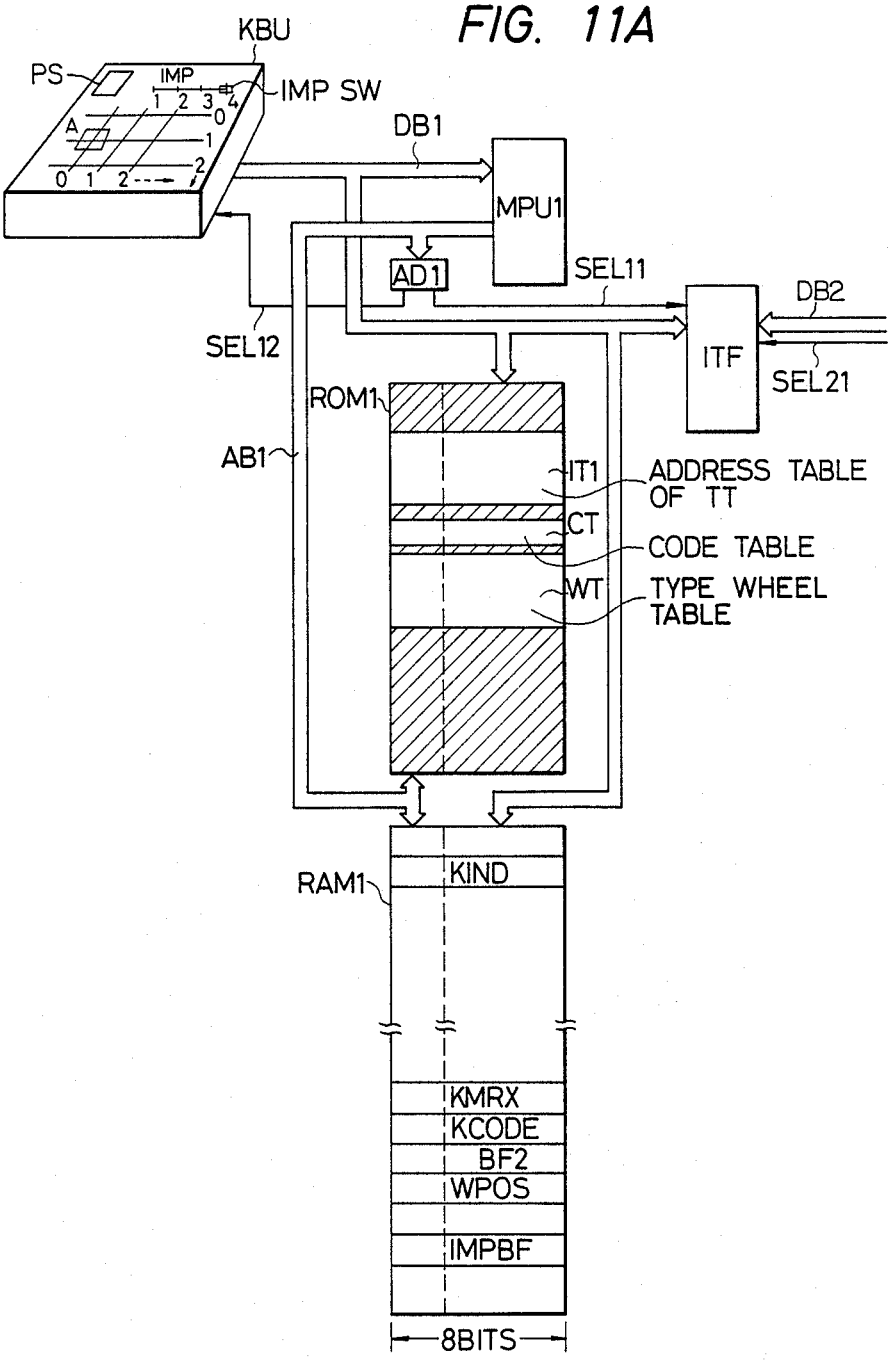
FIGS. 11A and 11B collectively are a block diagram of a printing apparatus according to a second embodiment of the present invention.
Figure 11B:
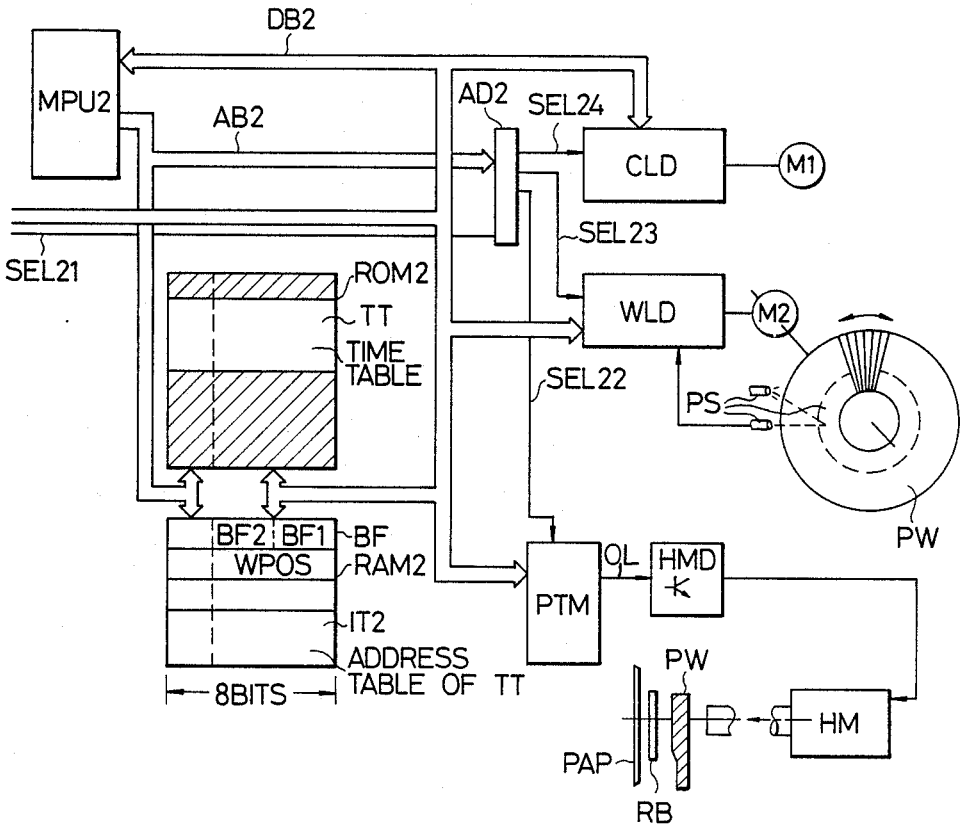

A printing apparatus according to a second embodiment of the present invention will be described with reference to FIGS. 11A and 11B. The same reference numerals used in FIGS. 1A and 1B denote the same or similar parts in FIGS. 11A and 11B, and a detailed description thereof will be omitted. However, an address table for the time table TT is arranged in the RAM2 as well as in the ROM1. The address table for the time table TT of the read-only memory ROM1 is identified as IT1, while the address table of the time table TT of the random access memory RAM2 is defined as IT2. The memory area BF of the random access memory RAM1 consists of only the portion BF2.

In the second embodiment, after the operator turns on a power switch PS, data for the kind of type style carried on the print wheel PW is written in the memory area KIND of the random access memory RAM1 in the same manner as in the first embodiment. Subsequently, the microprocessor MPU1 controls sequential read out of address data from the address table IT1 of the read-only memory ROM1 where address data is arranged in accordance with the order of the internal operating codes stored in the code table CT of ROM 1 (FIG. 6). The address data corresponding to 96 characters on a particular printing wheel PW installed in the printing apparatus at any one time is stored in the address table IT2 of the random access memory RAM2 of the microprocessor MPU2 through the interface ITF. Therefore, in the random access memory RAM2, address data corresponding to character number "0" is stored in address $(0080)_{HEX}$, and address data corresponding to character number "95" is stored in addresss $(00DF)_{HEX}$. In the address table IT1, assume that the internal operating code corresponds to character "A". The more significant portion of the internal operating code is hexadecimal "4", while the less significant portion thereof is hexadecimal "1". Therefore, the internal code is represented by $(41)_{HEX}$. In data $(36)_{HEX}$ at the address corresponding to the type CH character for "A" of the address table IT1, the more significant portion "3" (hexadecimal) represents part of the address data of the time table TT, while the less significant portion "6" (hexadecimal) represents pitch or proportional spacing data (data indicating the amount of feeding of the carriage CAR or ribbon RB by a ribbon advancing mechanism RBAM). The start address of the address table IT1 of the read-only memory ROM1 is represented by $(C2BA)_{HEX}$. Similarly, in the type wheel table WT, data indicating the rotation position of each character type CH on the printing type wheel PW is stored at addresses to be accessed by the more and less significant portions of the internal operating code, as shown in FIG. 7. Thereafter, the microprocessors MPU1 and MPU2 perform a sequence required at the initialization thereof. Thus, the operator can enter data with a key on the keyboard unit KBU.

Figure 12:
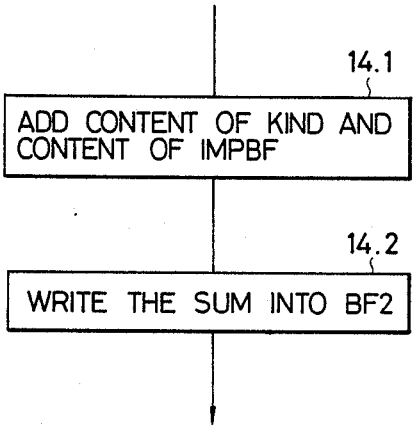
FIGS. 12 and 13 are flowcharts for explaining the mode of operation of the printing apparatus shown in FIGS. 11A and 11B.

The control operation after key depression is the same as that shown by the flowchart in FIG. 3. For performing necessary operations for printing, as shown in FIG. 12, first type style data in the memory area KIND of the random access memory RAM1 is added to the impression slide switch data in the memory area IMPBF in step 14.1. The sum is written in the portion BF2 of the random acess memory RAM1 in step 14.2.

Figure 8:
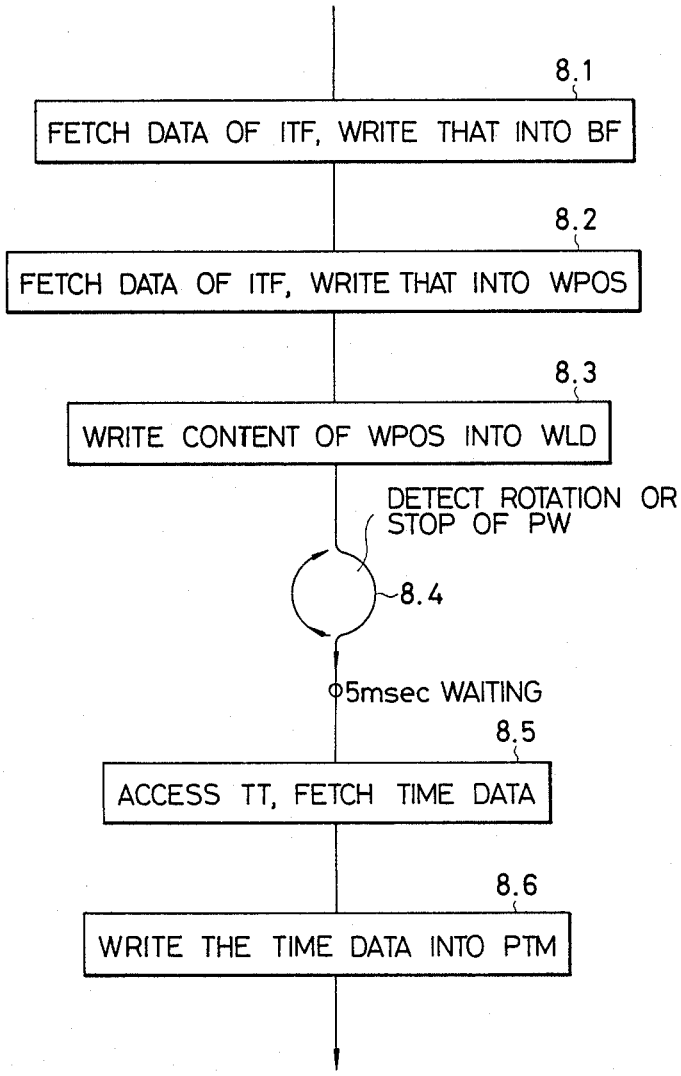
Figure 13:
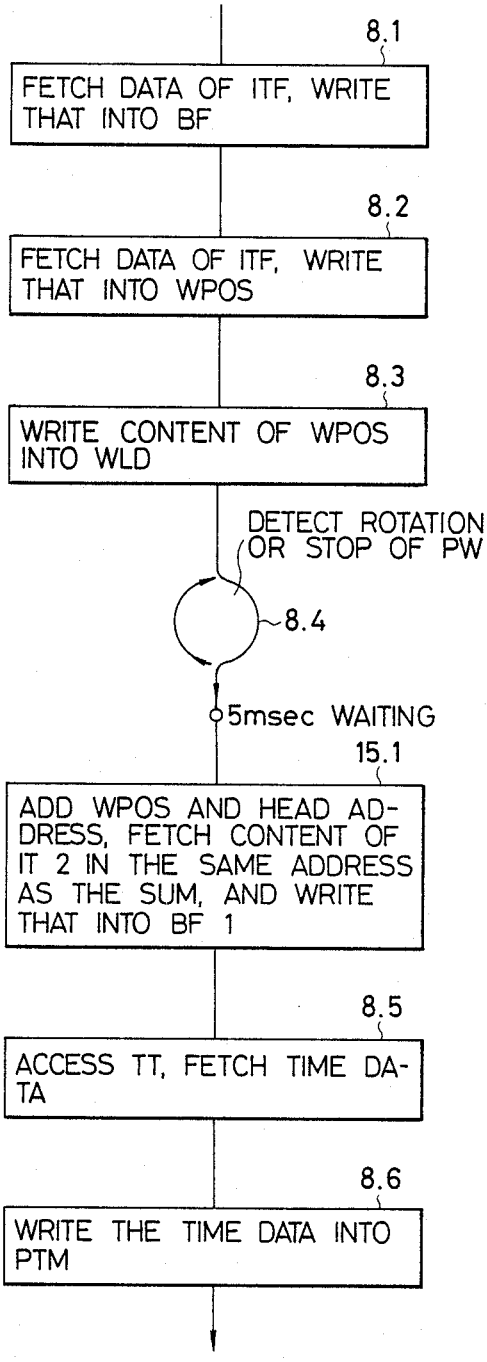

The position of a desired character type CH on the printing type wheel PW can be selected in the manner as shown in FIG. 5. Data in the memory areas BF and WPOS of the random access memory RAM1 is transferred from the microprocessor MPU1 to the microprocessor MPU2 through the interface ITF. Subsequently, in the steps shown in FIG. 13, the microprocessor MPU2 causes the wheel control/drive section WLD to fetch the data from the memory area WPOS, so that the wheel control/drive section WLD controls the servo motor M2 to rotate the printing type wheel PW and to set the target character type CH in the printing position. In loop 8.4, when interruption of rotation of the printing type wheel PW is detected, the microprocessor MPU2 waits for 5 msec, and the control sequence advances to step 15.1. The flowchart in FIG. 13 is fundamentally the same as that in FIG. 8. The first portion through step 8.4 of the same steps used in FIG. 8 are represented by the same step numerals in FIG. 13, and a detailed description thereof will be omitted. In step 15.1, the data in the data area WPOS is added to the head (or start) addres $(0080)_{HEX}$ of the address table IT2. The sum is defined as the head (or start) address to write data of the address table IT2 in the portion BF1 of the random access memory RAM2. Further, in step 8.5, data in the time table TT is accessed using data in the portion BF of the random access memory RAM2 so as to fetch the time data of the programmable timer PTM in the microprocessor MPU2. In step 8.6, the time data is stored in the programmable timer PTM. The access operation is substantially the same as that shown in FIG. 9. The hammer HM is driven in the direction indicated by the arrow in FIG. 11B on the basis of an output from the programmable timer PTM in which the time data is programmed. A character is printed with a hammer HM in correspondence with the operation where the operator presses a key once. Subsequently, the microprocessor MPU1 gives to the microprocessor MPU2 a command to move the carriage CAR. When the carriage CAR is moved, the next printing operation is ready to be performed.

What we claim is:

1. A printing apparatus comprising:

a typefont structure having a plurality of type members thereon;

a hammer for striking said type members to effect printing;

hammer drive means for driving said hammer and energizable for different durations to control printing impression;

a programmable timer coupled to said hammer drive means for controlling said durations;

input means for inputting desired character information indicating a type member to be selected for printing;

a time table storing a plurality of numbers having values equal to said durations;

retrieving means responsive to information, including the character information, for retrieving desired durations from said time table and for supplying said retrieved desired durations to said programmable timer, said retrieving means including arithmetic means for performing a calculation to generate information for accessing said time table for retrieving the durations;

selection information providing means responsive to desired character information from said input means for providing selection information for the selection of a desired one of said plurality of type members; and selecting means for performing the selection of said type member in response to the selection information;

said retrieving means being operative, after the selection of said type member by said selecting means and lapse of a predetermined period of time, to access said time table in response to the information from said arithmetic means to retrieve the desired durations therefrom and to supply said retrieved desired durations to said programmable timer; said arithmetic means conducting said calculation to access said time table that stores the plurality of numbers, which have no direct relation to the character information corresponding thereto.

2. Apparatus according to claim 1, wherein said programmable timer comprises clock means operable to provide clock pulses at a frequency such that one clock pulse is produced per a unit of time, and means for counting the clock pulses to a number thereof equal to the number accessed from said time table.

3. Apparatus according to claim 1, wherein said time table stores the plurality of numbers having values equal to said durations in units of microseconds.

4. Apparatus according to claim 1, wherein each said number stored in said time table is a two-byte number.

5. Apparatus according to claim 1, wherein the difference between a first pair of successive said numbers stored in said time table is such as to represent a difference in hammer drive duration of 400 microseconds: between a second pair of successive said numbers is such as to represent 300 microseconds; between a third pair of successive said numbers is such as to represent 200 microseconds; and between a fourth pair of successive said numbers is such as to represent 100 microseconds.

6. Apparatus according to claim 1, wherein said calculation performed by said arithmetic means is dependent upon both the character to be printed and upon further data.

7. Apparatus according to claim 6, wherein said further data is dependent upon the style of the type of said type members.

8. Apparatus according to claim 6, wherein said further data is dependent upon a manual selection operation for controlling printing impression.

9. Apparatus according to claim 6, wherein said further data is dependent both upon the style of the type of said type members and upon a manual selection operation for controlling printing impression.

10. Apparatus according to claim 9, wherein said arithmetic means performs said calculation on the basis of first impression data dependent upon the character to be printed and second impression data dependent upon said further data.

11. Apparatus according to claim 10, wherein said first impression data and said second impression data are utilized as addresses to identify in said time table the address of a said number stored therein whose value is appropriate to the combination of said first impression data and said second impression data.

12. Apparatus according to claim 1, wherein said retrieving means includes an impression table storing impression data for each said character.

13. Apparatus according to claim 12, wherein said impression table also stores supplementary information related to each said character.

14. Apparatus according to claim 13, wherein said supplementary information comprises character spacing information.

15. Apparatus according to claim 13, wherein the supplementary information comprises ink ribbon advancement information.

16. Apparatus according to claim 12, wherein said impression table is accessed by an address code which is also used by said selection information providing means to identify the location on said typefont structure of the character to be printed.

17. Apparatus according to claim 1, comprising a first microprocessor responsive to desired character information entered into said apparatus by said input means and operable to process said desired character information, and a second microprocessor, constituting at least in part said retrieving means and said selection information providing means, arranged to control the printing operation in response to processed information supplied by said first microprocessor.

18. Apparatus according to claim 17, wherein said time table is contained in a read only memory associated with said second microprocessor.

19. Apparatus according to claim 18, wherein said retrieving means includes an impression table contained in a read only memory associated with said first microprocessor.

20. Apparatus according to claim 19, including a random access memory associated with said second microprocessor, an interface, and means for writing into said random access memory impression data, obtained by reading said impression table, with said first microprocessor through said interface.

21. Apparatus according to claim 1, wherein said typefont structure is a daisywheel.

22. Apparatus according to claim 21, wherein said daisywheel is mounted on a linearly movable carriage.

23. An output apparatus comprising:

key input means capable of inputting desired character information;

a typefont structure having a plurality of type members thereon;

a hammer for striking said type members to effect printing;

hammer drive means for driving said hammer and energizable for different operational durations to control printing impression;

a programmable timer coupled to said hammer drive means for controlling the duration of energization of the hammer drive means;

impression data providing means for providing impression data representing a component of the operational duration;

a time table storing a plurality of numbers having values equal to said operational durations in units of time; and operable means, responsive to desired character information input by said key input means and the impression data provided by said impression data providing means, for calculating data for accessing said time table to retrieve operational durations from said time table and supply said retrieved operational durations to said programmable timer, said time table storing said numbers, which have no direct relation to the desired character information, that is accessed from said time table by the data calculated by said operable means.

24. An output apparatus according to claim 23, further comprising:

first buffer means for storing said impression data from said impression data providing means; and second buffer means for storing, in response to the input desired character information from said key input means, an index code for referring to said time table.

25. An output apparatus according to claim 23, wherein when said impression data providing means provides the impression data, the number stored in said time table is smaller than the number of characters which can be input by said input means.

26. An output apparatus according to claim 23, wherein said impression data providing means includes a slide switch.

27. An output apparatus according to claim 23, wherein said programmable timer comprises clock means operable to provide clock pulses at a frequency such that one clock pulse is produced per said unit of time, and means for counting the clock pulses to a number thereof equal to the number accessed from said time table.

28. An output apparatus according to claim 23, wherein each said number stored in said time table is a two-byte number.

29. An output apparatus according to claim 23, wherein said operable means includes an impression table storing impression data for each said character.

30. An output apparatus according to claim 29, wherein said impression table is accessed by an address code which is also used by said impression information providing means to identify the location on said typefont structure of the character to be printed.

31. An output apparatus according to claim 23, comprising a first microprocessor responsive to desired character information entered into said apparatus by said input means and operable to process said desired character information, and a second microprocessor, constituting at least in part said operable means, arranged to control the printing operation in response to processed information supplied by said first microprocessor.

32. An output apparatus according to claim 31, wherein said time table is contained in a read only memory associated with said second microprocessor.

33. An output apparatus according to claim 32, wherein said operable means includes an impression table contained in a read only memory associated with said first microprocessor.

34. An output apparatus according to claim 33, including a random access memory associated with said second microprocessor and means for reading said impression table into said random access memory prior to a printing operation.

35. An output apparatus according to claim 23, wherein said typefont structure is a daisywheel and said apparatus further comprises a linearly movable carriage on which said daisywheel is mounted.

36. An output apparatus according to claim 23, wherein the difference between a first pair of successive said numbers stored in said time table is such as to represent a difference in hammer drive duration of 400 microseconds; between a second pair of successive said numbers is such as to represent 300 microseconds; between a third pair of successive said numbers is such as to represent 200 microseconds; and between a fourth pair of successive said numbers is such as to represent 100 microseconds.

* * * * *

UNITED STATES PATENT AND TRADEMARK OFFICE

CERTIFICATE OF CORRECTION

PATENT NO. : 4,747,709

DATED : May 31, 1988

INVENTOR(S) : HIROYUKI UEDA, ET AL.

It is certified that error appears in the above-identified patent and that said Letters Patent is hereby corrected as shown below: Title Page:

AT [56] IN THE REFERENCES

Foreign Patent Documents,
"2110853 6/1983 United Kingdom ..... 157.3/"
should read
--2110853 6/1983 United Kingdom ..... 400/157.3--.

AT [57] IN THE ABSTRACT

Line 4, "Thse" should read --These--.

IN THE DRAWINGS

Sheet 6, Figure 7,
"CHAR-" should read --CHAR--- (six occurrences).
ACTOR ACTER

COLUMN 1

Line 20, "mentioned" should read --mentioned above--.
Line 36, "printing" should read --a printing--.
Line 62, "FIG. 1;" should read --FIGS. 1A and 1B;--.

COLUMN 3

Line 67, "output OL" should read --output line OL--.

COLUMN 4

Line 21, "microporcessor" should read --microprocessors--.
Line 51, "hexidecimal-- should read --hexadecimal--.

UNITED STATES PATENT AND TRADEMARK OFFICE

CERTIFICATE OF CORRECTION

PATENT NO. : 4,747,709

DATED : May 31, 1988

INVENTOR(S) : HIROYUKI UEDA, ET AL.

It is certified that error appears in the above-identified patent and that said Letters Patent is hereby corrected as shown below:

COLUMN 5

Line 11, "is it" should read --if it--.
Line 21, "WHen" shoud read --When--.
Line 28, "hexideci-" should read --hexadeci---.
Line 33, "Hexidecimal" should read --Hexadecimal--.
Line 57, "the the" should read --the--.
Line 60, "ribbom" should read --ribbon--.

COLUMN 6

Line 13, "relating to data" should read --data relating to--.
Line 29, "position of" should read --position on--.
Line 37, "hexidecimal" should read --hexadecimal--.

COLUMN 7

Line 44, "number. Each number that represents the address data" should read --number that represents the address data in BF in RAM 2. Each number--.
Line 45, "in BF in RAM 2" should be deleted.

COLUMN 8

Line 44, "type CH character" should read --character type CH--.

UNITED STATES PATENT AND TRADEMARK OFFICE

CERTIFICATE OF CORRECTION

PATENT NO. : 4,747,709

DATED : May 31, 1988

INVENTOR(S) : HIROYUKI UEDA, ET AL.

It is certified that error appears in the above-identified patent and that said Letters Patent is hereby corrected as shown below:

COLUMN 9

Line 2, "acess" should read --access--.
Line 18, "The flowchart" should read --The first portion through step 8.4 of the flowchart--.
Line 19, "first" should be deleted.
Line 20, "portion through step 8.4 of the" should be deleted.

COLUMN 10

Line 34, "400 microseconds:" should read --400 microseconds;--.

Signed and Sealed this

Fifteenth Day of November, 1988

*Attest:*

*Attesting Officer*

DONALD J. QUIGG

*Commissioner of Patents and Trademarks*